United States Patent [19]

Lemke

[11] Patent Number: 4,620,828

[45] Date of Patent: Nov. 4, 1986

[54] DEVICE FOR TILTING AND TURNING COKE-OVEN DOORS FOR MAINTENANCE PURPOSES

[75] Inventor: Otto Lemke, Recklinghausen, Fed. Rep. of Germany

[73] Assignee: Carl Still GmbH & Co. KG., Fed. Rep. of Germany

[21] Appl. No.: 557,911

[22] Filed: Dec. 5, 1983

[30] Foreign Application Priority Data

Dec. 7, 1982 [DE] Fed. Rep. of Germany ..... 3245138

[51] Int. Cl.[4] ..... B66F 11/00

[52] U.S. Cl. ..... 414/684.3; 49/199

[58] Field of Search ..... 49/199; 414/684.3

[56] References Cited

U.S. PATENT DOCUMENTS 1,357,058 10/1920 Hubbell ..... 414/684.3
4,306,831 12/1981 Matsuno et al. ..... 414/684.3

FOREIGN PATENT DOCUMENTS 1753229 7/1957 Fed. Rep. of Germany .
1177600 12/1959 Fed. Rep. of Germany .
975016 6/1961 Fed. Rep. of Germany .
2142706 11/1981 Fed. Rep. of Germany .
3044848 7/1982 Fed. Rep. of Germany .

*Primary Examiner*—William E. Wayner
*Attorney, Agent, or Firm*—McGlew and Tuttle

[57] ABSTRACT

The invention relates to a device for tilting and turning coke-oven doors for the purpose of maintenance and repair. It comprises a door-receiving support frame with upper guide rollers, which are guided in a guide rig having parallel rail pairs. At the lower end of the support frame a firmly connected drive device engages, which is movable on a raised horizontal rail track. The drive device pulls the support frame from the vertical into the horizontal position and pushes it back into the vertical position. The guide rig includes a vertical part and an inwardly extending part contiguous thereto. The center between the guide rig on the coke side and the guide rig on the machine side is interrupted. The rail pairs end at the bottom in sturdy stops for the guide roller. The invention is thus an accident proof tilting device, with sufficient space for repair purposes being available on the working platform.

8 Claims, 3 Drawing Figures

DEVICE FOR TILTING AND TURNING COKE-OVEN DOORS FOR MAINTENANCE PURPOSES

BACKGROUND OF THE INVENTION

1. Field of the Invention

The invention relates to coking and in particular to a new and useful device for tilting and turning coke-oven doors for the purpose of maintenance and repair.

From the literature essentially three kinds of door tilting devices are known. In a first kind (cf. e.g. German Pat. No. 975,016 and German OS 30 44 849), the coke-oven door is brought by the door liftoff device to the free end of the coke oven battery and is there suspended in a frame set up vertically. Then the frame with the door is lowered by tackle onto horizontal rails, and after the door has been overhauled, it is erected again in corresponding manner. Such devices, where doors weighing tons are moved up and down by cable lines, are, as always when transporting heavy loads by cable lines, not operationally safe and accident proof, as experience has shown.

The second kind of tilting device is arranged on a carriage of its own wheelable on the operating platform of the coking oven battery, the tilting and turning devices being actuated by means of a series of hydraulic cylinders. Here, too, the upper free end of the tilting and turning frame is pivoted up and down and rotated without any additional guide. In particular with oven doors of a length of seven meters and longer as customary today, very high torques result. Consequently the device must be made extremely stable, hence involving great expense. Moreover, the pivoting of the free end of the holding device entails considerable hazards for the operators on the platform. These tilting devices with hydraulic cylinders are described, among others, in German Pat. No. 21 42 706 and in German utility model No. 17 53 229.

Lastly from German AS 11 77 600 a door tilting device with positive guiding of the support frame with rollers is known, which rollers are guided in a guide rig consisting of a vertical and a horizontal rail pair and a transition rail pair connecting the horizontal rail pair. Here the support frame in vertical positions is provided at its upper end with guide rollers, and its lower end is connected articulatedly with a carriage wheelable on a track disposed parallel to the horizontal rail of the bogie. In addition to this carriage a separate drive carriage is provided, with must be coupled and uncoupled and which also is movable on the lower track. For repair purposes, moreover, a separarte hoisting device is needed, with which the frame and the oven door in it can be lifted into a horizontal position. To turn the door into this position, separate pivot pins must be mounted.

SUMMARY OF THE INVENTION

The invention provides an accident proof tilting device wherein costly coupling and uncoupling of the drive carriages is obviated and sufficiently space for repair purposes is available on the working platform. Moreover, the costly additional hoisting and turning device is to be obviated.

For the solution of this problem it is proposed that the guide rig consisting of rail pairs comprise a vertical part and a part contiguous thereto at the bottom which extends obliquely inward and is interrupted in the center between the guide rig on the coke side and guide rig on the machine side, and the rail pairs end at the bottom in sturdy stops for the guide rollers and that the drive device is movable on a horizontal, raised rail track.

According to the design of the invention, in the first place provision is made for an accident proof tilting device with positive guide of the support frame. In contrast to the state of the art, the guide rig is interrupted rather than continuous in the horizontal region on the working platform. Therefor, after the support frame with the coke oven door inserted therein has been brought into the horizontal position on the working platform, the crew can work on the door without being hindered by the guide rig and rails. On one side the support frame hangs on the raised, horizontally moveable drive device and, when in the horizontal position over the working platform, it is held at the lower stops of the guide rig. Even in the vertical position of the support frame, the drive device always remains connected therewith. Hence coupling and uncoupling of the drive device to and from the support frames is not necessary.

The invention further provides that the drive device takes support on the horizontal, raised rail track through counter-pressure rollers, and the sprocket wheels of the drive engage in roll chains which are arranged below and/or above the horizontal rail track of the drive device. Hence the drive device is guided on the rail track positively and is protected against canting in cases of alternating load.

According to the invention, it has proved to be favorable that at the free end of the support frame, where it is connected with the jib, a rotary drive with brake system is arranged, for rotating the door held in the support frame into any desired angular position. It is indeed known from German Pat. No. 975,016 how to design the door frame for longitudinally axial rotation also in horizontal position, but how this rotation in horizontal direction is to be carried out has not been described there. Because of the unsymmetrical arrangement of the oven door in the support frame, rotation by hand in horizontal directions is hardly possible, so that in the past the door must be rotated always in a vertical position, then must be layed over. To change the position, to turn it there accordingly, and then to lower it again. By means of the proposal of the invention it is possible to turn the door into any desired angular position also in horizontal direction without having to bring the support frame and door into the vertical position again first.

In this connection, the invention also provides that the support frame in horizontal position is arranged so high above the working platform that with the door hooked in it is freely rotatable about the entire horizontal longitudinal axis. For the removal of heavy parts of the door body or of the door plug, the door can now be turned so that the respective parts fall perpendicularly onto the working platform.

A considerable improvment in accident safety is provided also by the fact that the horizontal rail is arranged wheelable above the horizontal position of the support frame, at least so high that the operator standing on the working platform has sufficient headroom under it. In contrast to the known devices where the drive and the respective rail runway are arranged correspondingly high above the platform (preferably about 1.8 to 3 m).

In tilting the door with the previously existing tilting devices after insertion into the support frame by the door lift-off device at the servicing machine hydraulically or by means of a cable winch, it was heretofore necessary to raise the door again about one half to one meter with special lifting devices for certain repair jobs. This special lifting device is not necessary if, as the invention proposes, one lets the horizontal rail track for the drive device drop off obliquely to the level given by the door left-off device or respectively by the plane of the oven floor into the end position at both ends. After insertion of the door into the upright support frame, the drive device first runs up the slope and brings the door to the respective working level and then runs on the horizontal rail track toward the center until the upper guide rollers of the support frame abut against the lower stops of the guide rig.

The connection between the drive device and the support frame is designed, according to the invention, in such a way that the drive device is connected with the lower jib of the support frame via a rectangular jib, the horizontal leg of the jib being articulatedly mounted at its free end on the drive device, and takes support on the raised rail track in the bend through guide rollers, and at the free end of the jib leg directed vertically downward the support frame is hooked in articulatedly (hinged). By the rectangular design of the jib with the leg directed vertically downward, at which the end of the support frame is suspended, the necessary clearance between rail track and support frame is created, also the necessary headroom for the operator. Due to the articulated suspension at the lower jib end and at the lower crosspiece, the support frame can pivot up or down while the drive device moves, according to the rolling off of the guide rollers at the flat rails in the guide rig.

In particular for increased safety during operation it is further proposed that in the upper region of the guide rig, at the end away from the door left-off device, a counter-pressure rail is arranged, which is to prevent canting of the support frame in the vertical position.

Accordingly it an object of the invention to provide an improved device for lifting and tilting coke oven doors, which includes a guide rig for guiding a coke oven door support frame which engages with a then roller portion in the guide rig and is guided thereby through a movment which turns the door.

A further object of the invention is to provide a tilting device for coke oven doors which is simple in design rugged in construction and economical to manufacture.

The various features of the invention which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENTS

Figure 1:
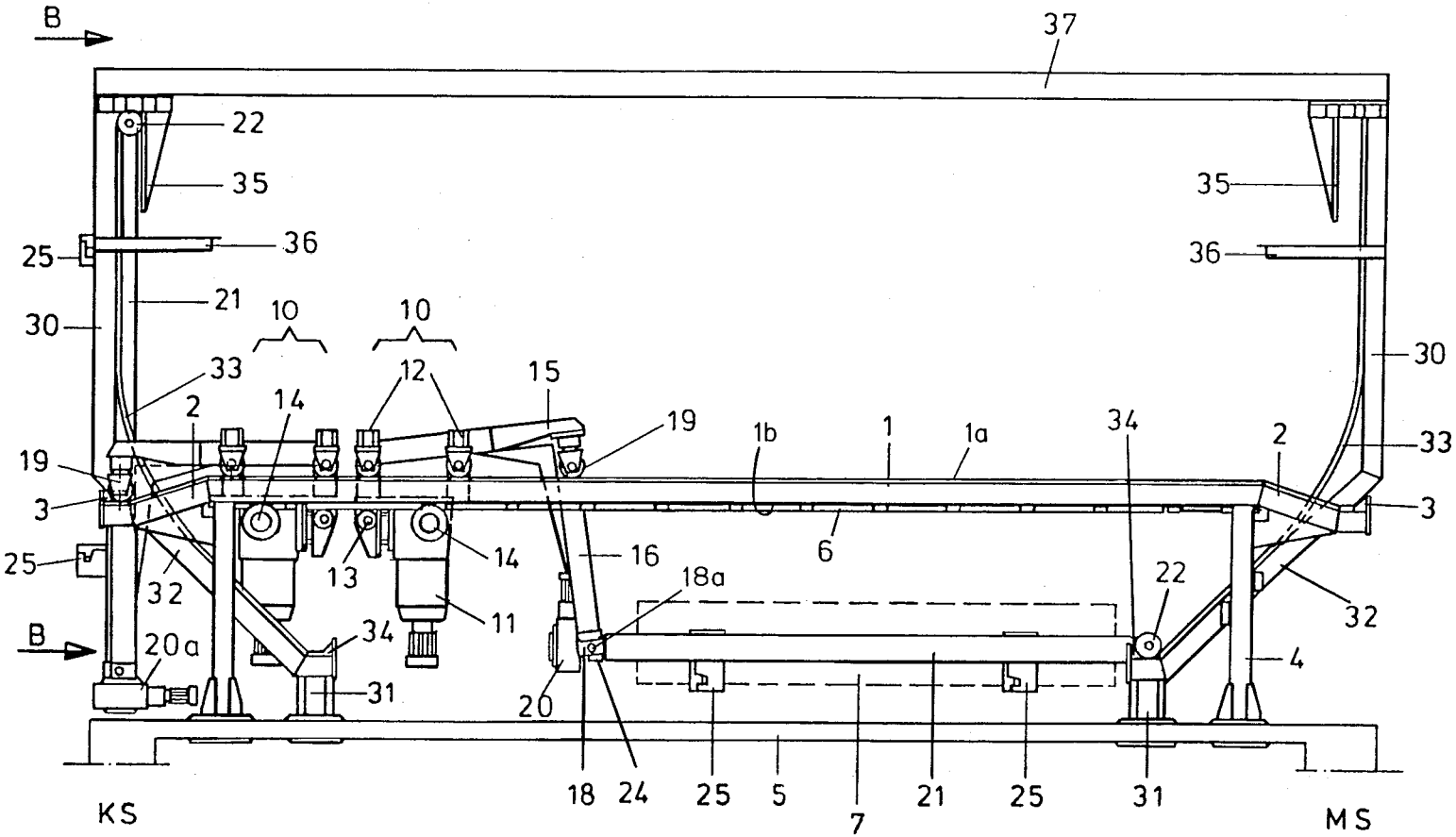
FIG. 1 is a front elevational view of the entire device according to the invention.

Referring to the drawings in particular the invention embodied therein comprises a device for tilting and turning coke oven doors such as a door 7 which comprises a guide rig 30 mounted in a fixed location over a working platform 5 and which includes a lower stop portion 34 supported on props 31 on the platform 5 in a generally upwardly extending trackway along which rollers 22 from a coke oven door support frame 21 are guided. In accordance with the invention the coke oven door support frame 21 is moved with the door 7 secured thereto such as by shackles 25, by a drive device pin which has guide rollers 19 which are guided over a rail track 1 which is arranged at a relatively great elevation above the platform 5 out of the way of the operating devices. The drive device moves along the trackway 1 to effect the tilting and turning of the door 7.

FIG. 1 illustrates a device for tilting and turning coke-oven doors as arranged on the working platform 5 at the end of a coke-oven battery. On the coke side KS as well as on the machine side MS there is a guide rig with the vertical part 30 and a slanting part 32 and also lower stops 34 on a prop 31 which stands on the working platform 5. The upper end of the guide rig is fastened at an upper platform 37. FIG. 1 illustrates further, by way of example, the support frame 21 and the drive device 10 for the doors on the coke side KS of the battery with frame 21 in vertical position. The drive device and support frame 21 for the doors of the machine side MS of the coke-oven battery are illustrated with an inserted door, which has a door plug and door body (not shown) in horizontal position.

The upper end of the horizontal machine side support frame 21 is illustrated with the guide rollers 22 at the lower stops 34. The other end 24 of the illustrated machine side support frame 21 is suspended at the end 18 of the vertical jib part 16. The jib is essentially rectangular (also see FIG. 2), the horizontal part 15 of the jib being arranged above the rail track 1 of the drive device 10. In the bend of the jib are guide rollers 19, which move on upper flat rail **1*a* of track 1. The jib 15 to 18 is articulatedly connected with the drive device at pivots 17*a* of the end 17. This drive device includes the bogie 12, which moves on four rollers on the rail track 1, of a shell type gear motor 11, which is mounted hanging from the bogie 12 and drives two sprocket wheels 14 via a continuous shaft. As the drive device 10 moves, the sprocket wheels 14 engage in the sprocket chain 6 below the track and thus produce necessary compression and traction forces. The guide rollers 19 in the bend of the jib are secured to the horizontal jib part 15 through buffer springs not shown, so that the impact as the oven door sets down into the support frame is damped, and also slight differences in height in the track can be equalized. At the lower end 18 of the jib two bearings 18*a*, are screwed on. Into these bearings pivot pins of the lower crosspiece 24 of support frame 21 are introduced. The compression acting at the bearings at the end 18 of the jib when the drive devices are moved create via the guide roller pair 19 as pivot point a lift force at the end 17 of the jib. To counteract this lift force, two counter-pressure rollers 13 are disposed at the bogie 12 below the rail track 1. These counter-pressure rollers run along lower flat rails 1*b* below the rail track 1** during travel of the drive device.

The rail track 1, on which the drive device 10 together with the jib is moved back and forth includes two symmetrical frames, which are secured with two props 4 about 2 m high on the working platform 5. The height of the props 4 was chosen so great in order to remove the layout of the working area and thus to obtain a very good accessability of the horizontally arranged door 7. On the top of the ail track 1 the upper flat rail 1*a* is welded on, as a track for the two drive devices on the machine and coke sides. On the underside of the rail track 1 between the two props 4, the sprocket chain 6 is fastened and clamped, into which the sprocket wheels 14 of the drive device engage, thus creating the necessary comparison and traction forces. In addition, there is welded on the underside the lower flat rail 1*b*, along which the counter-pressure rollers 13 roll. The rail track is slanted downward or angularly bent at the two ends 2 and possesses at the end a stable stop device 3. The slant makes it possible to bring the support frame 21 with the bearing block 28 (see FIG. 3) for the oven door 7 to the level of the oven floor and, when moving into the horizontal position, to lift the support frame 21 with the oven door so far that between platform 5 and the support frame 21 sufficient clearance is created to permit rotation of the frame with the inserted oven door into the horizontal position. The stops 3 at the end of the rail track prevent overstepping of the end positions.

The upper region of the guide rig 30, counter-pressure rails 35 are provided, which prevent canting of the support frame in the vertical position and which upon insertion of the oven door absorb the force resulting due to the hitting of the stops 26 and 27 in the support frame (see FIG. 3) by a coke oven servicing machine. As the support frame moves, the guide rollers 22 run along first on the vertical part 30 of the guide rig, then on a curved piece 33 which in the lower region changes over to a 45° slope, and at the end of the trip they stand horizontally above prop 31.

Figure 2:
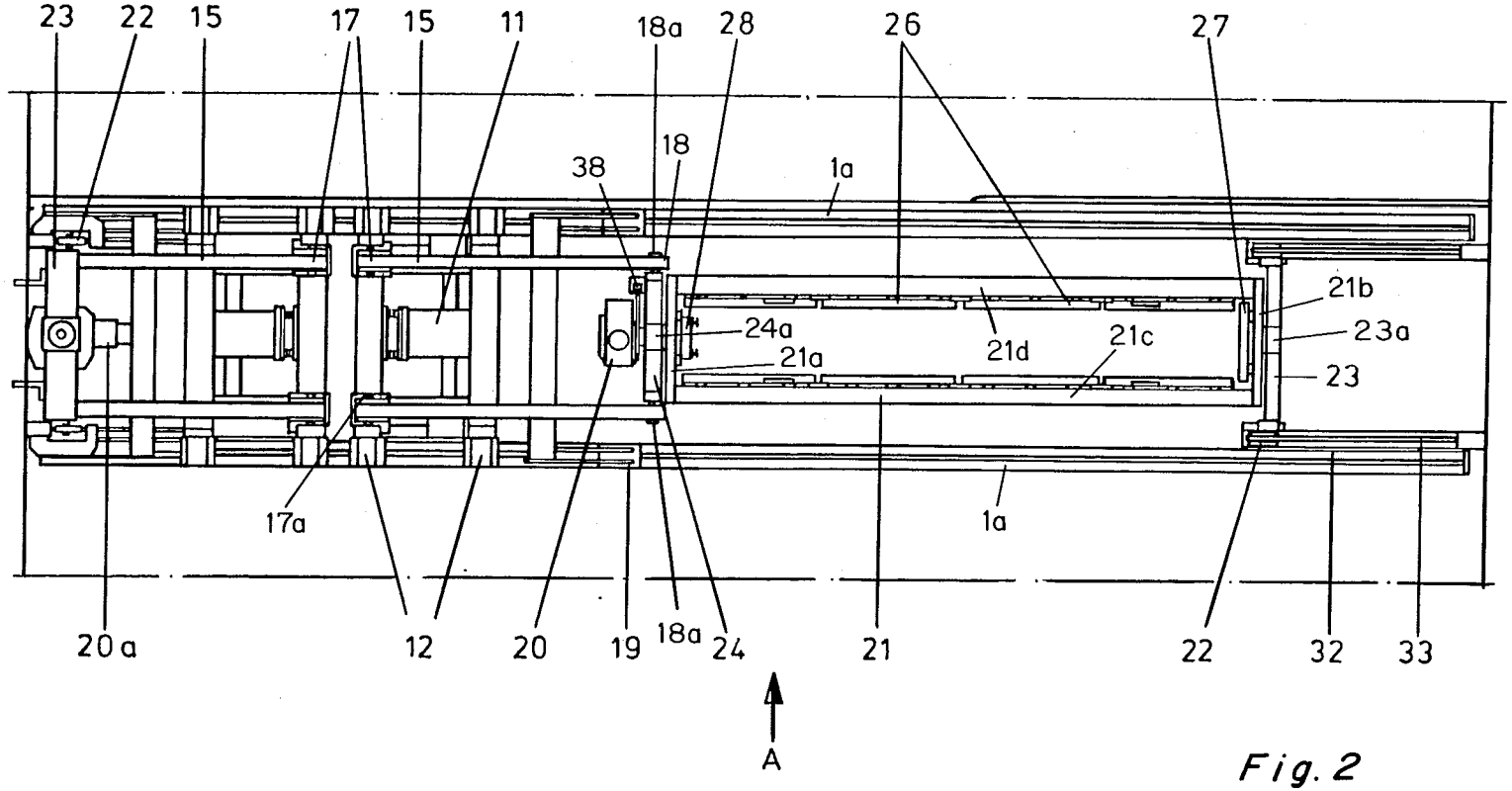
FIG. 2 is a top plan view of the device.
Figure 3:
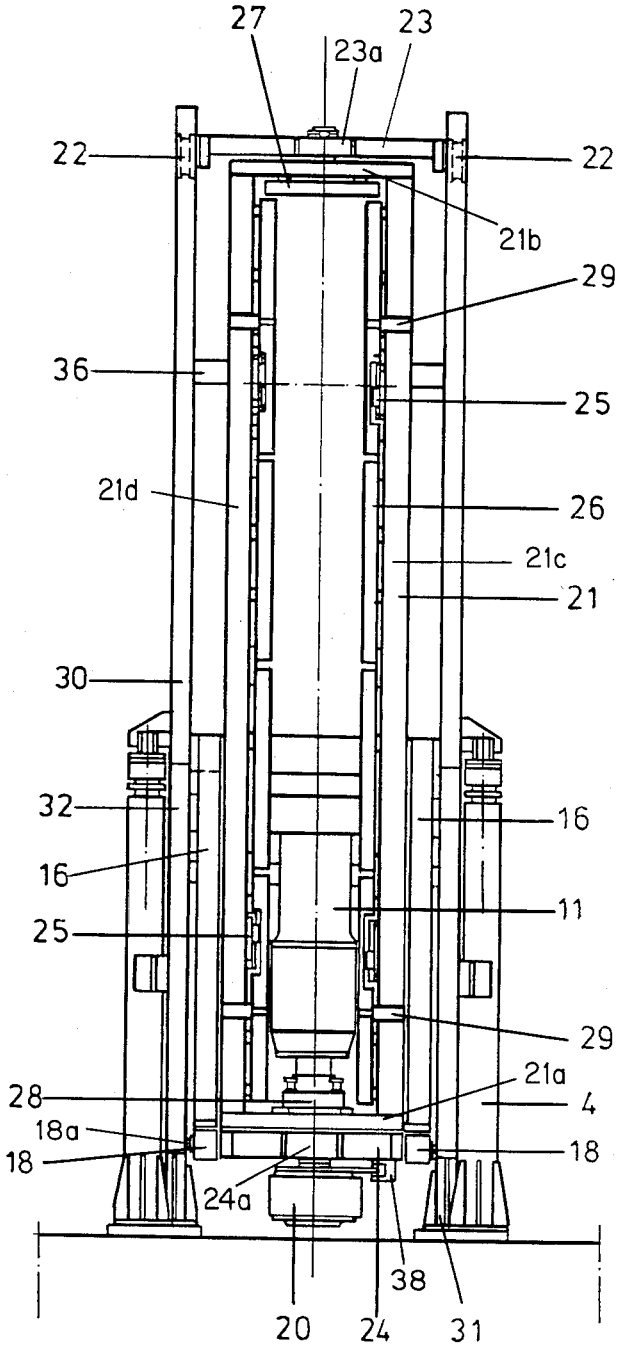
FIG. 3 is a lefthand elevational view of the device on an enlarged scale.

From FIGS. 2 and 3 can be seen in particular the construction of the support frame 21. It comprises a construction with hollow sections 21*a*, 21*b*, 21*c* and 21*d* and is mounted at the bottom and top for longitudinal-axial rotation in the cross-pieces 23 and 24 by means of pins 23*a* and 24*a*. On the lower pin 24*a* is fitted a gear motor 20 as rotary drive with brake motor, which is articulated to the crosspiece 24 by way of a torque prop 38. The lower crosspiece 24 is equipped at the ends with two pivot pins which are introduced into the bearings 18*a* at the end 18 of the jib, so that when the drive device moves a pivotal motion of the support frame 21 can occur.

The support frame itself is equipped with four adjustable latch hooks 25 into which latch bars of the oven door are pivoted. The frame has several angle pieces 26, 27 on which applies sealing edges of the oven door and which can be taken off for repair purposes at the sealing edge. The frame also has a vertically adjustable and removable bearing block 28, for the setting down of the oven door in the vertical position, and four pressure props 29 for the clamping of the oven door frame in order to prevent a slipping of the door in the support frame during rotation in the horizontal position.

A shackle 36 in the upper part of the guide rig 30 is provided to prevent a falling through of the oven door during insertion, in case the application of the stops 26, 27 in the support frame after the repair operation should be forgotten.

While a specific embodiment of the invention has been shown and described in detail to illustrate the application of the principles of the invention, it will be understood that the invention may be embodied otherwise without departing from such principles.

What is claimed is:

1. A tilting and turning device for coke oven doors, comprising a fixed guide rig including a bottom stop and a trackway extending upwardly from said stop, a coke oven door support frame having a coke oven door engaging portion with an end part having a roller engaged on said trackway, a drive device articulated to said coke oven door support frame, and means defining a guide track over said stop over which said roller of said door support frame is movable.

2. A device according to claim 1, wherein said guide rig includes an obliquely extending portion extending upwardly from said stop and a substantially vertical portion extending upwardly from said obliquely extending portion, said two of said tracks arranged on a coking side and a machine side respectively having a central interrupting portion, said stop including support props mounted in a fixed position said drive device being movable on a raised rail track.

3. A device according to claim 1, wherein said drive device includes rollers including a raised rail track over which said rollers are engaged said drive device having counter-pressure rollers engaging said track from below said track including a sprocket chain extending there along and said drive including a sprocket wheel engaged with said sprocket chain.

4. A device according to claim 2, wherein said guide rig comprises a support frame, a jib carrying said support frame for rotation and a rotary drive and brake system connected to said support frame with shifting said support frame into a desired angle.

5. A device according to claim 4, including a working platform, said support frame being mounted on said working platform for rotation there above, wherein in one said support frame is in a horizontal position it is arranged high above the working platform so that the coke oven door freely rotatable about the entire horizontal longitudinal axis.

6. A device according to claim 5, wherein said means defining a guide track includes a central portion and an end portion at each end which extends downwardly from said central portion, said means mounting said trackway above said stop.

7. A device according to claim 1, including a rectangular jib, which means mounting said support frame for pivoting adjacent the lower end of said frame on said jib, said jib having a horizontal leg articulatedly mounted connected to said drive device, said drive device including a support member having a support roller engaged on said trackway, said coke oven door support frame including a lower leg portion terminating in a roller resting on said stop and a vertical jib part pivotably connected to said lower leg portion and to said drive device, said drive device having a support arm portion with a support arm roller engaged on said track.

8. A device according to claim 1, wherein said guide rig includes a substantially vertically extending rail portion it means defining a counter-pressure rail spaced from said rail portion to prevent said frame from canting in the vertical direction.

* * * * *